US006736207B2

(12) United States Patent
Luca et al.

(10) Patent No.: US 6,736,207 B2
(45) Date of Patent: May 18, 2004

(54) INTERNAL BLOW-OUT PREVENTER CHANGE-OUT TOOL

(75) Inventors: Gilles Luca, Hellerup (DK); Gary J. Faciane, Jr., Lafayette, LA (US)

(73) Assignee: ENSCO International Incorporated, Dallas, TX (US)

( * ) Notice: Subject to any disclaimer, the term of this patent is extended or adjusted under 35 U.S.C. 154(b) by 62 days.

(21) Appl. No.: 10/125,765

(22) Filed: Apr. 18, 2002

(65) Prior Publication Data

US 2003/0006043 A1 Jan. 9, 2003

Related U.S. Application Data

(60) Provisional application No. 60/303,692, filed on Jul. 6, 2001.

(51) Int. Cl.[7] ..... E21B 19/06; E21B 33/06

(52) U.S. Cl. ..... 166/85.1; 166/77.51; 166/77.52; 166/377; 166/85.4; 166/85.3; 175/85

(58) Field of Search ..... 175/173, 195, 175/85; 166/377, 85.3, 85.4, 85.1, 77.52, 77.53, 77.51, 379

(56) References Cited

U.S. PATENT DOCUMENTS

| | | | | |
|---|---|---|---|---|
| 2,482,616 | A | * | 9/1949 | Gregory et al. ..... 166/85.1 |
| 3,796,418 | A | | 3/1974 | Carlberg |
| 3,815,209 | A | | 6/1974 | Basile |
| 4,291,762 | A | | 9/1981 | Gudgel |
| 4,442,892 | A | | 4/1984 | Delesandri |
| 4,466,314 | A | | 8/1984 | Rich |
| 4,478,279 | A | | 10/1984 | Puntar et al. |
| 4,846,271 | A | | 7/1989 | Delesandri |
| 5,092,399 | A | | 3/1992 | Lang |
| 5,806,589 | A | | 9/1998 | Lang |
| 6,276,450 | B1 | | 8/2001 | Seneviratne |

FOREIGN PATENT DOCUMENTS

| | | |
|---|---|---|
| CA | 2306714 | 11/2000 |

OTHER PUBLICATIONS

International Search Report dated Sept. 17, 2002 for PCT/US02/19174.

* cited by examiner

*Primary Examiner*—David Bagnell
*Assistant Examiner*—Giovanna Collins
(74) *Attorney, Agent, or Firm*—Fish & Richardson P.C.

(57) ABSTRACT

A device for use in removing and installing an inline component from a drill string that is depending downward over a deck. The device has an elongate member with a flange adapted to abut the deck and support the elongate member in a substantially upright orientation, and an engagement member on the elongate member adapted to rotably engage the inline component.

19 Claims, 4 Drawing Sheets

INTERNAL BLOW-OUT PREVENTER CHANGE-OUT TOOL

This application claims the benefit of U.S. Provisional Application No. 60/303,692 filed Jul. 6, 2001.

BACKGROUND OF THE INVENTION

1. Technical Field of the Invention

The present invention relates generally to accessory equipment for use in drilling wells, and more particularly to a tool for removing and installing a device, such as an upper inside blow-out preventer (IBOP), from a section of a drill string.

2. Description of Related Art

During drilling of a well that may encounter a source of subterranean pressure, such as an oil and gas well, one or more inside or internal blowout preventers (IBOPs) are placed inline with the drill string to prevent uncontrolled flow of fluids and gas up the center of the drill string. Typically, the drill string will have a lower IBOP threaded into the uppermost joint of drill pipe, and an upper IBOP threaded in-between the lower IBOP and top drive sub. At various points during the drilling operation, for example to add or remove additional joints of drill pipe, the IBOPs must be removed and re-installed.

Removal and re-installation of the lower IBOP can be performed with a pipe handler on the top drive unit, and is fairly routine. The upper IBOP, on the other hand, generally cannot be removed with the pipe handler, because it is above and out of the pipe handler's reach. In the past, the upper IBOP has been removed and installed manually using pipe tongs. However, equipment suspended from the top drive unit, such as the pipe handler itself and elevator link-tilts, hinder access necessary to engage the tongs on the upper IBOP. Therefore, to remove the IBOP any equipment that is in the way must first be removed, and afterwards must be reinstalled.

Removal and re-installation of the elevator link-tilts, pipe handler, and other equipment is both time consuming and cumbersome. Neither the pipe handler nor the elevator link-tilts are easily manhandled, and each has multiple connections that must be removed and reinstalled. The problem is exacerbated in that much of the work must be performed from a ladder to reach the equipment. The drilling operations must be stopped during the change-out, and thus completion of the well is delayed during the change-out operations. Not only is it inconvenient to remove the equipment, but the delay in completion increases the cost of the well and the time before the well can be placed in production.

Therefore, there is a need for a tool which minimizes the time to change-out equipment such as an upper IBOP and the like that are not conveniently accessed by the pipe handler.

SUMMARY OF THE INVENTION

The invention is drawn to a tool for use in changing-out an inline component from a drill string that is not conveniently accessed by the pipe handler. The tool includes an elongate member with a flange adapted to abut the deck and support the elongate member in substantially upright orientation. The elongate member has an engagement member that is adapted to rotably engage the inline component.

The invention also includes a tool that has a pedestal member of which one end is insertable into an opening in the deck and the other end is adapted to engage and translate torque to an element of the drill string.

The invention also includes a method for removing an inline component from a downwardly depending drill string wherein an elongate member is inserted into a deck beneath the drill string such that the elongate member can rotate about an axis substantially perpendicular to the deck. The drill string is lowered over the elongate member such that the component is in proximity to an end of the elongate member. The component is engaged by an engagement member on the elongate member and the drill string is secured against rotation. The elongate member is rotated thereby rotating the component to unscrew the component from the drill string.

Advantages of the invention will become apparent from the foregoing drawings and detailed description.

BRIEF DESCRIPTION OF THE DRAWINGS

Various objects and advantages of the invention will become apparent and more readily appreciated from the following description of the presently preferred exemplary embodiments, taken in conjunction with the accompanying drawings of which.

DETAILED DESCRIPTION OF THE EXEMPLARY EMBODIMENTS OF THE INVENTION

Figure 1:
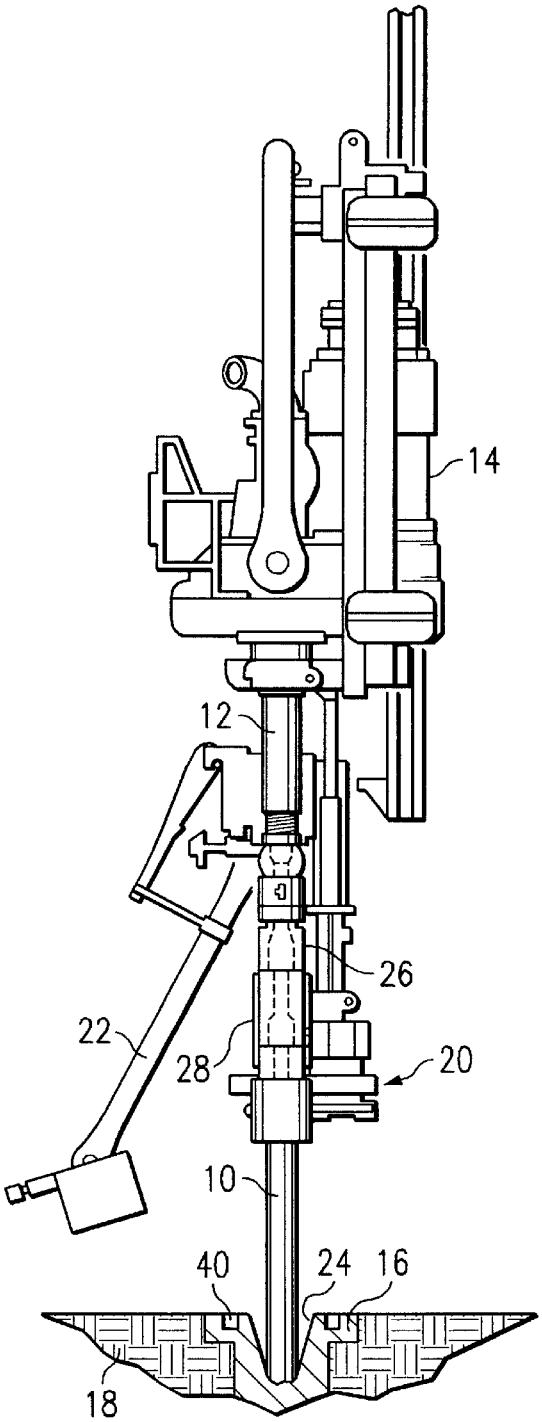
FIG. 1 is a partial side view of a well drilling operation.

Reference is now made to the drawings wherein like reference numerals denote like or similar parts throughout the Figures.

Referring to FIG. 1, during the drilling of a well, the drill string 10 is connected to a rotary drive output 12 (resembling a portion of drill pipe) of a top drive unit 14 and extends down through a rotary table 16, an element of the deck 18 of a drilling platform. The drill string 10 includes multiple joints of drill pipe and other components used in drilling the well. The top drive unit 14 provides torque to rotate the drill string 10 during drilling. A pipe handler 20 and other equipment, for example elevator link-tilts 22, are supported from the top drive 14. The pipe handler 20 can be operated to grasp and rotate the top joint of the drill string 10 for use in adding or removing joints of drill pipe and other inline components that are threaded together to form the drill string 10. Finally, the rotary table 16 is a portion of the deck 18 that can be unlocked to rotate about an axis perpendicular to the deck 18 (inline with the drill string) or can be locked into the deck 18 so as not to rotate. The rotary table 16 has an opening 24 that allows passage of the drill string 10 therethough.

The drill string 10 can have one or more inline components including an upper IBOP 26 and a lower IBOP 28, usually positioned between the drill string 10 and the top drive unit 14. While the lower IBOP 28 can be installed and removed using the pipe handler 20, similarly to the manner by which joints of drill pipe are installed and removed from the drill string 10, the pipe handler 20 cannot reach the upper IBOP 26.

Figure 2A:
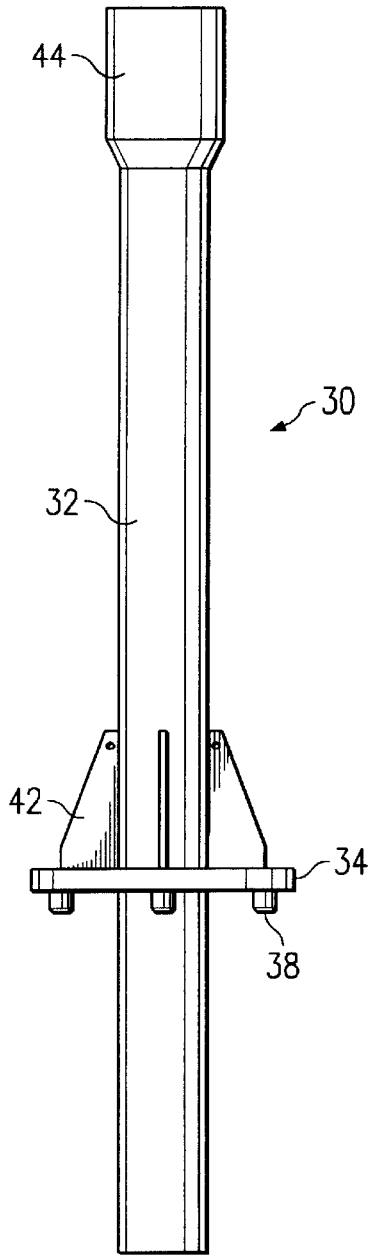
FIG. 2A is a side view illustrating an internal blow-out preventer change-out tool constructed in accordance with the invention.
Figure 3A:
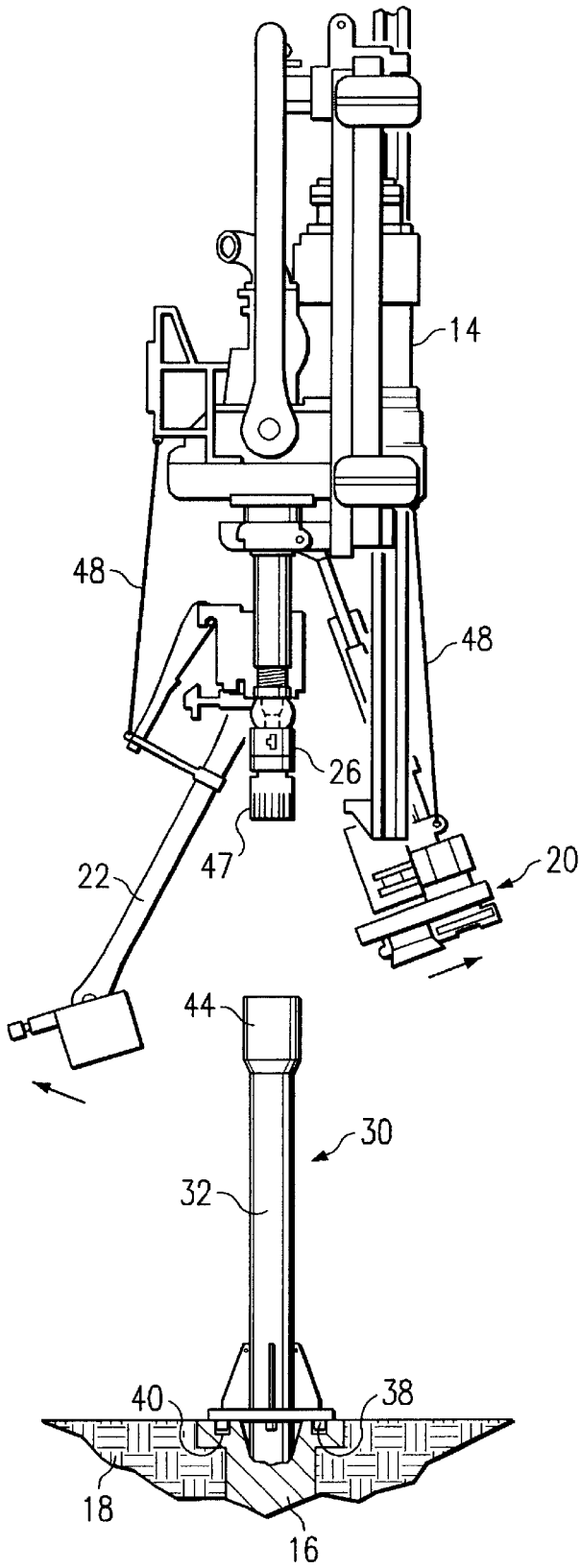
FIGS. 3A, 3B, and 3C are sequential side views illustrating the change-out tool of FIG. 2A used in accordance with the invention.
Figure 3B:
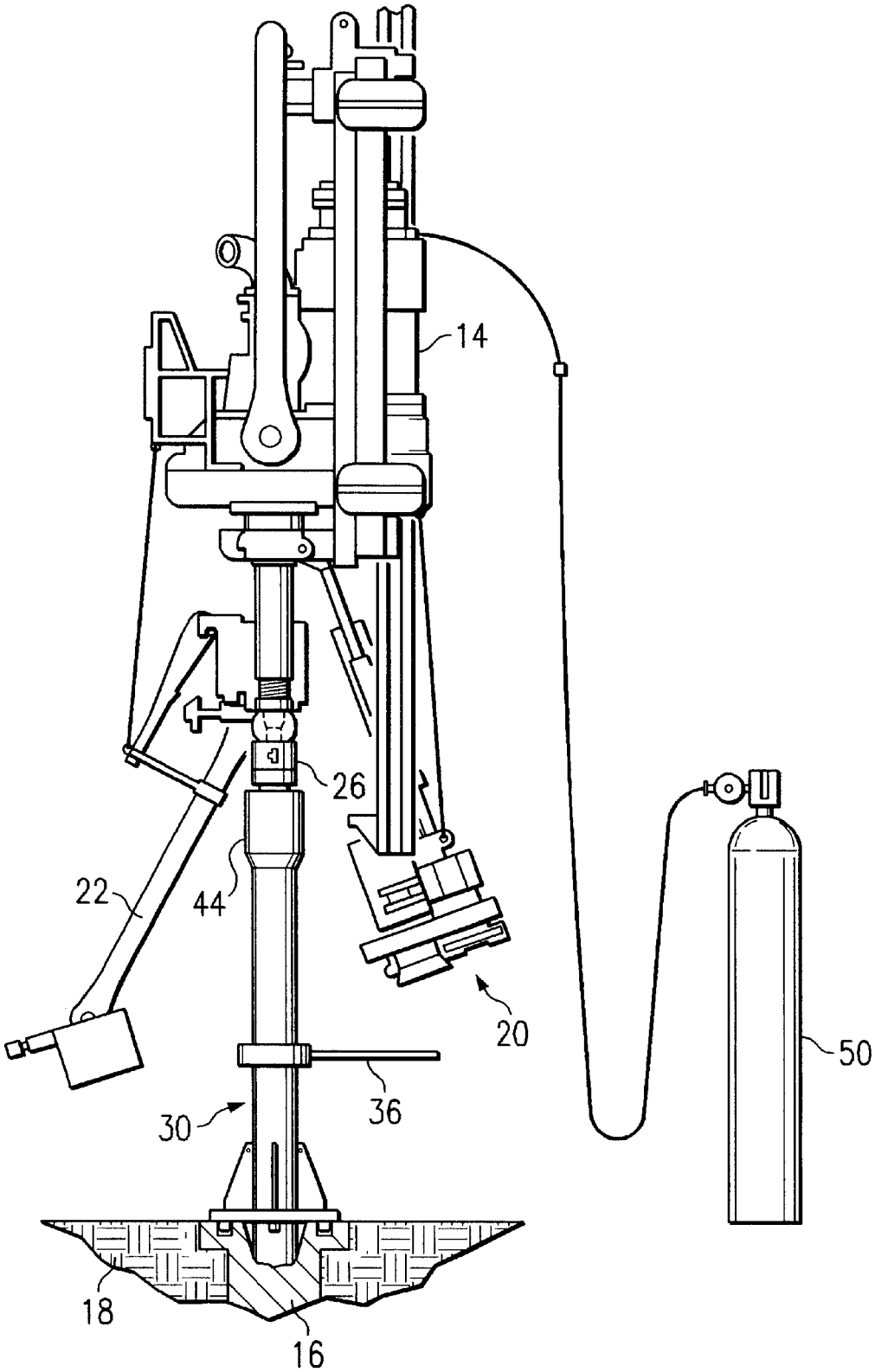
Figure 3C:
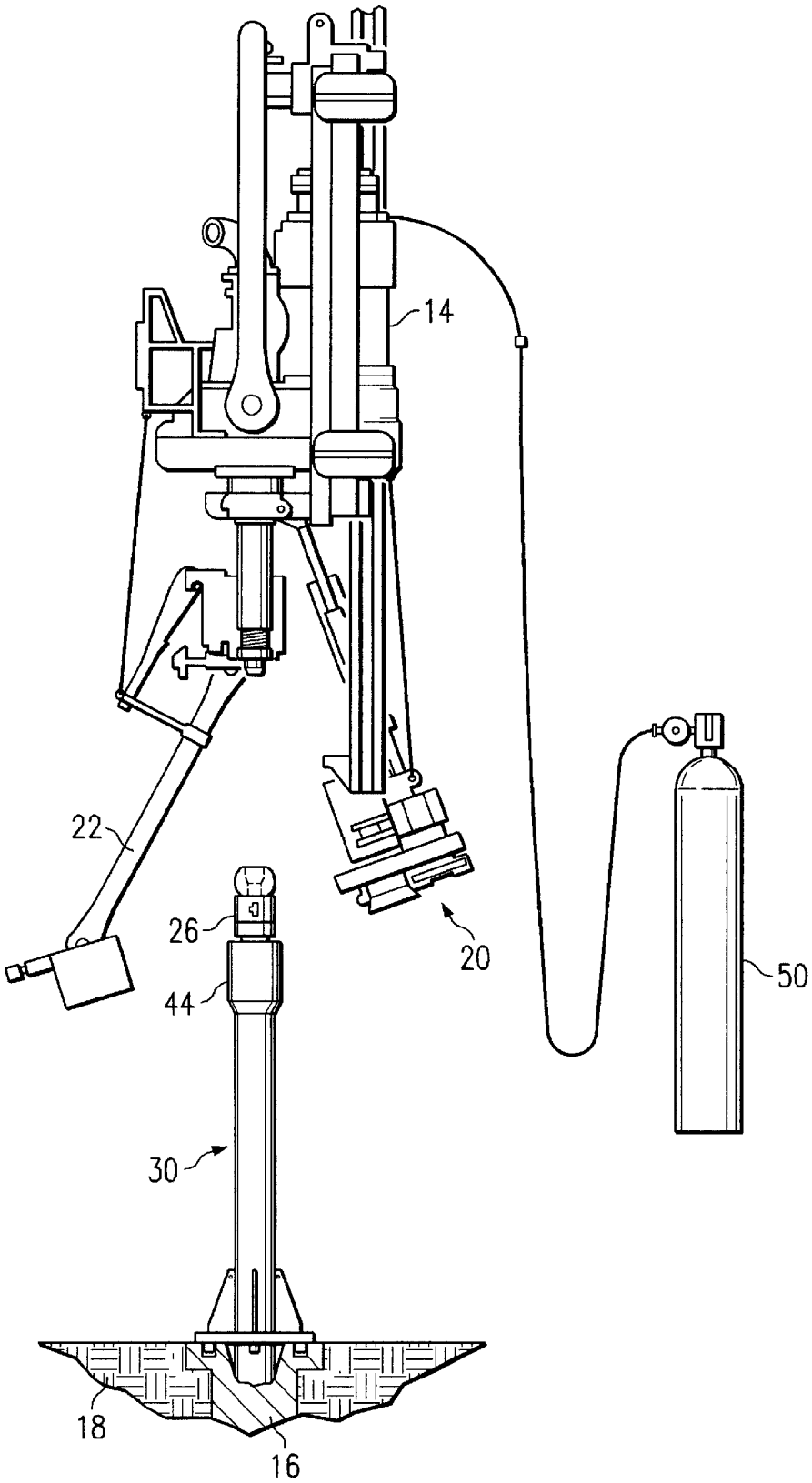

Referring to FIG. 2A, a change-out tool 30 constructed in accordance with this invention has an elongate pedestal portion 32 with a generally planar flange 34 affixed thereto. A portion of the pedestal 32 can extend past the flange 34, and is sized for insertion into the opening 24 of the rotary table 16 as depicted in FIGS. 3A–C. The flange 34 is affixed to the pedestal 32 in substantially perpendicular relation to the longitudinal axis of the pedestal 32. As such, when the pedestal 32 is inserted into the rotary table 16 (FIGS. 3A–C), the flange bears against the deck 18 and supports the tool 30 in substantial vertical orientation, perpendicular to the deck 18. The flange 34 also can have one or more pins 38 extending outward from its surface that are adapted for insertion into corresponding receptacles 40 of the rotary table 16. Additional bracing, such as gussets 42, can be provided between flange 34 and pedestal 32 to make the relationship more rigid. Thus, with the rotary table 16 unlocked, the change-out tool 30 can be rotated together with the rotary table 16 about the axis of rotation of the rotary table 16. The flange can be sized to bear only against the rotary table 16 portion of the deck 18, so that it will not drag on the remainder of the deck 18 when rotated together with the rotary table 16. At least a portion of the pedestal 32 can have a profile in cross-section that is circular and is approximately the same diameter a drill pipe in the drill string 10, so that the pedestal 32 can be manipulated with devices adapted to manipulate the drill string 10, for example pipe tongs 36. Pipe tongs 36 are a manually manipulated device that is adapted to grasp and rotate a pipe, for example to make-up (add) or break-out (remove) a joint of drill pipe from a drill string. Also, the pedestal 32 can be tubular to minimize weight and material costs.

Figure 2B:
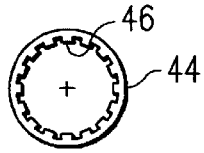
FIG. 2B is a partial top view of the change-out tool of FIG. 2A.

At an end of pedestal 32 opposite the flange 34, the change-out tool 30 has an engagement member 44 adapted to engage and transfer torque to the component to being changed-out, such as the upper IBOP 26. In the exemplary embodiment depicted in FIG. 2B, the engagement member 44 can be a female receptacle having, for example, a splined female profile 46 to engage a corresponding splined male profile 47 (best seen in FIG. 3A) on the exterior of the upper IBOP 26. Alternately, other profiles can be provided, for example but in no means by limitation, a J-lock, hexagonal profile, or threaded connection.

In use, the change-out tool 30 eliminates the need to remove the elevator link-tilts 22 and pipe handler 20 or other equipment depending from the top drive unit 14, because it provides a surface clear of the equipment on which to engage the tongs 36. Thus, the time required to install and remove the upper IBOP 26 is reduced.

Referring to FIGS. 3A–C, before use of the change-out tool 30 to remove an inline component, the pipe handler 20 and elevator link-tilts 22 are secured out of the work area, for example with cable ties 48. The top drive unit 14 is raised, and the change-out tool 30 inserted into the rotary table 16. The top drive unit 14 is then lowered into proximity with the tool 30, and the upper IBOP 26 is stabbed into the engagement member 44. The rotary table 14 is unlocked so that it can rotate freely, and the brake of the top drive unit 14 is set so that the drive output 12 cannot rotate. The brake on the top drive unit 14 is generally pressure actuated, for example pneumatically, and can be supplemented with a higher pressure external source 50 if needed. The tongs 36 can then be used to grasp and rotate the pedestal portion 32 of the change-out tool 30, thereby rotating and unscrewing the upper IBOP 26 from the top drive unit 14. Use of the change-out tool 30 to install the upper IBOP 26 is similar; however the steps are reversed.

The change-out tool is described herein in use with an upper IBOP, but the same apparatus and method are equally applicable to the installation and removal of other inline devices and components joined inline in a drill string, between joints of drill pipe or the drill string and top drive, for example but in no means by limitation, a saver sub. Also, the pedestal need not necessarily include the flange or insert into the rotary table to be operable.

Although several exemplary embodiments of the methods and systems of the invention have been illustrated in the accompanying drawings and described in the foregoing description, it will be understood that the invention is not limited to the embodiments disclosed, but is capable of numerous rearrangements, modifications and substations without departing from the spirit and scope of the invention as defined in the following claims.

We claim:

1. A device for use in removing or installing an inline component of a drill string, the drill string depending downward over a deck and having one or more bodies thereabout, comprising:

an elongate member;

a flange on the elongate member adapted to abut the deck and support the elongate member in a substantially upright orientation;

an engagement member on the elongate member adapted to rotably engage the inline component; and wherein the elongate member has a surface adapted for engagement by pipe tongs and adapted to be substantially clear of the one or more bodies when the engagement member engages the inline component.

2. The device of claim 1 wherein a portion of the elongate member is adapted to be inserted into an opening in the deck.

3. The device of claim 1 wherein the deck has a rotary table adapted to rotate substantially about the axis of the drill string, and wherein the flange is adapted to abut the rotary table.

4. The device of claim 3 wherein the flange has pins adapted for insertion into corresponding receptacles in the rotary table.

5. The device of claim 1 wherein a profile of the elongate member in cross-section is substantially circular.

6. The device of claim 1 wherein an outer diameter of the elongate member is approximately equal to an outer diameter of the drill string.

7. The device of claim 1 wherein the inline component is an internal blow-out preventer.

8. The device of claim 1 wherein the engagement member rotably engages the inline component by internally receiving at least a portion of the inline component.

9. The device of claim 1 wherein the downwardly depending drill string is an output shaft of a top drive unit.

10. A tool for changing out an element of a drill string positioned over a deck, the drill string having one or more bodies thereabout, the tool comprising:

a pedestal member having a lower end insertable into an opening in the deck, the other end adapted to engage and translate torque to the element of the drill string, and a surface adapted for engagement by pipe tongs and adapted to be substantially clear of the one or more bodies when the end of the pedestal member engages the element of the drill string.

11. The tool of claim 10 further comprising a flange on the pedestal member adapted to abut the deck and support the pedestal member in substantially perpendicular relation to the deck.

12. The tool of claim 10 wherein a profile of the pedestal member in cross-section is substantially circular.

13. The tool of claim 10 wherein an outer diameter of the pedestal member is approximately equal to an outer diameter of a drill pipe in the drill string.

14. The tool of claim 10 wherein the element of the drill string is an internal blow-out preventer.

15. The tool of claim 10 wherein the drill string is an output of a top drive unit.

16. A method for removing an inline component from a downwardly depending drill string, comprising:

inserting an elongate pedestal into a deck beneath the drill string such that the elongate pedestal can rotate inline with the axis of the drill string;

lowering the drill string over the elongate pedestal such that the inline component is in proximity to an upper end of the elongate pedestal;

engaging the inline component with an engagement member on the elongate pedestal;

securing the drill string against rotation;

securing a pipe handler depending downward about the drill string away from the inline component;

engaging the elongate pedestal with pipe tongs; and rotating the pedestal with the pipe tongs thereby rotating the inline component to disconnect the component from the drill string.

17. The method of claim 16 wherein the drill string is an output shaft of a top drive unit.

18. The method of claim 17 wherein the top drive unit has elements depending downwardly therefrom, the method further comprising:

securing the elements away from the inline component of the drill string being removed.

19. The method of claim 17 wherein securing the drill string against rotation comprises setting a pressure actuated brake of the top drive unit using an outside pressure source.

* * * * *